US005826510A

United States Patent [19]

Haupenthal

[11] Patent Number: 5,826,510

[45] Date of Patent: Oct. 27, 1998

[54] ADJUSTMENT DEVICE FOR ADJUSTING THE HEIGHT OF GRIPPER IMPACT BARS DISPOSED DIAMETRICALLY OPPOSITE ONE ANOTHER ON SHEET-GUIDING CYLINDER OF A PRINTING PRESS

[75] Inventor: Rudi Haupenthal, Epfenbach, Germany

[73] Assignee: Heidelberger Druckmaschinen AG, Heidelberg, Germany

[21] Appl. No.: 991,894

[22] Filed: Dec. 17, 1997

[51] Int. Cl.[6] ..... B41F 27/12

[52] U.S. Cl. ..... 101/415.1; 101/378

[58] Field of Search ..... 101/415.1, 382.1, 101/383, 378

[56] References Cited

U.S. PATENT DOCUMENTS

| | | | |
|---|---|---|---|
| 4,831,931 | 5/1989 | Jeschke et al. | 101/415.1 |
| 5,335,046 | 8/1994 | Bosy | 101/415.1 |
| 5,398,609 | 3/1995 | Stiel | 101/415.1 |
| 5,452,659 | 9/1995 | Pupic | 101/415.1 |
| 5,488,904 | 2/1996 | Kleinschmidt et al. | 101/415.1 |
| 5,562,036 | 10/1996 | Barrois et al. | 101/378 |

FOREIGN PATENT DOCUMENTS

4337578A1 5/1995 Germany .

*Primary Examiner*—Eugene H. Eickholt
*Attorney, Agent, or Firm*—Herbert L. Lerner; Laurence A. Greenberg

[57] ABSTRACT

An adjustment device for adjusting the height of gripper impact strips in a sheet-guiding cylinder for a printing press having two diametrically opposing gripper bars disposed at the cylinder circumference and made up of gripper shafts, grippers and gripper impact strips, includes respective adjusting shafts provided for the gripper impact strips, a coupling connecting the adjusting shafts to one another and compensating for an axial adjusting movement of the adjusting shafts, and an actuating element actuatable from the cylinder circumference for adjusting the height of the gripper impact strip at at least one of the gripper bars.

6 Claims, 1 Drawing Sheet

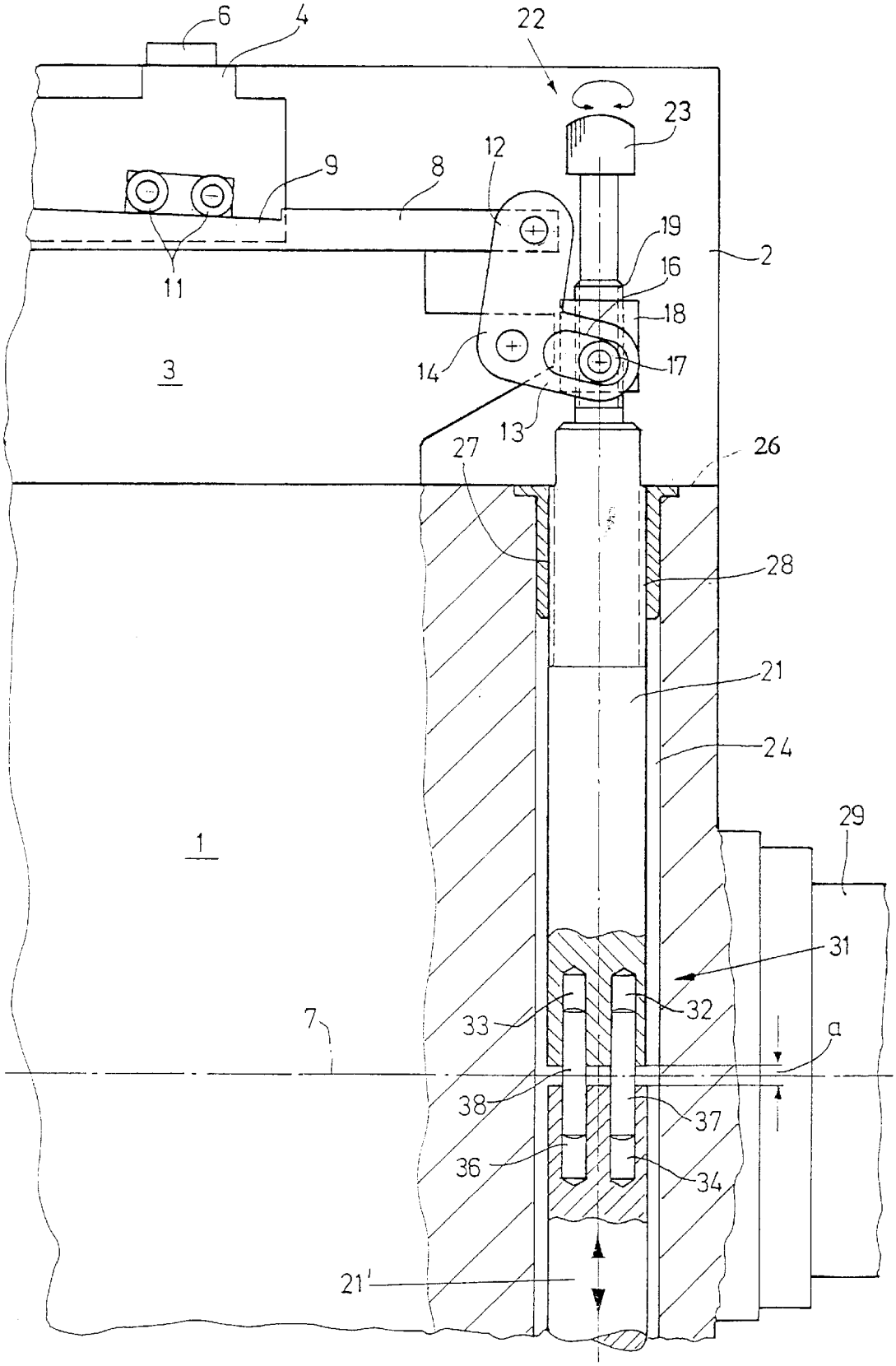
6
4
22
23
12
9
8
19
2
16
11
18
3
14
17
13
27
26
28
21
24
1
29
31
7
33
32
a
38
37
36
34
21'

ADJUSTMENT DEVICE FOR ADJUSTING THE HEIGHT OF GRIPPER IMPACT BARS DISPOSED DIAMETRICALLY OPPOSITE ONE ANOTHER ON SHEET-GUIDING CYLINDER OF A PRINTING PRESS

BACKGROUND OF THE INVENTION

Field of the Invention

The invention relates to an adjustment device for adjusting the height of gripper impact bars disposed opposite one another on sheet-guiding cylinders of a printing press.

An adjusting device of this general type has become known heretofore from the published German Patent Document DE 43 37 578 A1 wherein there is shown a sheet-guiding drum with two diametrically opposing gripper bars, respectively, having a gripper impact bar which is adjustable in radial direction by an axial adjusting movement effected by an adjustment device. The adjustment device is actuated by suitably provided adjustment elements via a drum journal of the sheet-guiding drum.

Such actuating locations require considerable constructional outlay and are accessible only with great difficulty by an operator.

It is accordingly an object of the invention to provide an adjustment device for adjusting the height of diametrically opposing gripper impact bars on sheet-guiding cylinders of a printing press having an actuating device which is actuatable starting from the circumference of the respective cylinder, and is thus readily accessible to the operator. A further object of the invention is to provide such an adjustment device which is of relatively simple construction and is consequently economically producible.

SUMMARY OF THE INVENTION

With the foregoing and other objects in view, there is provided, in accordance with the invention, in a sheet-guiding cylinder for a printing press having two diametrically opposing gripper bars disposed at the cylinder circumference and made up of gripper shafts, grippers and gripper impact strips, an adjustment device for adjusting the height of the gripper impact strips, comprising respective adjusting shafts provided for the gripper impact strips, a coupling connecting the adjusting shafts to one another and compensating for an axial adjusting movement of the adjusting shafts, and an actuating element actuatable from the cylinder circumference for adjusting the height of the gripper impact strip at at least one of the gripper bars.

In accordance with another feature of the invention, each of the gripper bars is provided with one of the actuating elements.

In accordance with a further feature of the invention, the adjustment device includes an adjusting strip, and a rocker arm for transmitting a rotary adjusting movement of a respective adjusting shaft into a translatory adjusting movement of the adjusting strip.

In accordance with an added feature of the invention, the coupling is formed of two aligned receivers, respectively, provided in the adjusting shafts, and respective entrainers received in the receivers and connecting the adjusting shafts to one another.

In accordance with an additional feature of the invention, the receivers are bores, and the entrainers are pins, respectively, received in the bores.

In accordance with a concomitant feature of the invention, at least one of the entrainers is axially displaceably disposed with respect to the respective adjusting shaft in at least one of the receivers.

A conversion of a rotary movement into a translatory adjusting movement by a rocker arm increases the useful adjustment path, whereby the adjustment device is especially finely adjustable.

In a particularly advantageous construction of the adjustment device according to the invention, a torque-transmitting displaceable coupling is provided by which axial movements of the threadedly mounted adjusting shaft is compensated for.

By an arrangement of the actuating elements for the adjustment device on each of the two opposing gripper devices on a so-called double-sized transfer drum, the latter can be actuated from the one or the other side, depending upon the more desired position, respectively.

Other features which are considered as characteristic for the invention are set forth in the appended claims.

Although the invention is illustrated and described herein as embodied in TITLE, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Other features which are considered as characteristic for the invention are set forth in the appended claims.

Although the invention is illustrated and described herein as embodied in adjustment device for adjusting the height of gripper impact bars disposed diametrically opposite one another on sheet-guiding cylinders of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The single figure of the drawing is a fragmentary diagrammatic plan view, partly in section, of a printing-press cylinder provided with the adjustment device according to the invention.

DESCRIPTION OF THE PREFERRED EMBODIMENTS

Referring now to the figure of the drawing, there is shown therein a cylinder 1 of a rotary printing press having two diametrically opposed cylinder gaps 2 wherein, respectively, gripper devices 3,4,6 made up of gripper bars 3 with gripper strips 4 and grippers 6 mounted thereon are disposed.

Because the gripper devices are arranged mirror-symmetrically, in the interest of simplification and brevity, only one gripper device 3,4,6 is illustrated and described herein.

The gripper strip 4 is mounted so as to be adjustable in height and, for this purpose, is in operative engagement with an adjusting strip 8 disposed so as to be axially displaceable in parallel with the axis 7 of the cylinder 1. The adjusting strip 8 has several wedge elements 9 distributed over the length thereof whereon the gripper strips 4, respectively, are mounted through the intermediary of adjustable pins or bolts 11.

A rocker arm 14 having two legs 12 and 13 is disposed at an end of the adjusting strip 8. At the intersection of the perpendicularly disposed legs 12 and 13, the rocker arm 14 is pivotally mounted on the gripper bar 3. Formed at the free end of the leg 13 is a slot 16 wherein a guide pin 17 engages. The guide pin 17 is seated on a threaded sleeve 18 which is disposed, fixed against rotation on a thread 19 of an adjusting shaft 21, so as to be radially variable with respect to the cylinder 1. At an end of the adjusting shaft 21 facing towards the opening of the cylinder gap 2, an actuating location 22 in the form of an adjustment head 23 is provided. The adjusting shaft 21 is disposed in a throughbore 24 extending from the non-illustrated cylinder gap to the cylinder gap 2 shown in the figure of the drawing. At the respective bases 26 of the cylinder gaps 24, an internally threaded bore member 27 is provided wherein the adjusting shaft 21 formed with an external thread 28 engages. Approximately at the level of a journal 29 for the cylinder 1, the mirror-symmetrically disposed adjusting shafts 21 and 21' are mutually coupled by a displaceable coupling 31. The coupling 31 includes pairs of bores 32,33 and 34,36, respectively, formed endwise in each of the adjusting shafts 21, the respective bores 32 and 34, on the one hand, and 33 and 36, on the other hand, being aligned with one another. The mutually aligned adjusting shafts 21 and 21' are spaced a distance a from one another. A respective pin 37,38, is received in common in each of the aligned pairs of bores 32 and 34, on the one hand, and 33 and 36, on the other hand. The pins 37 and 38, respectively, are displaceably disposed in at least one of the bores 32,34 and 33,36, respectively. Due to these constructional features, the adjusting movements of the adjusting shafts 21 and 21' in radial direction with respect to the cylinder 1 are compensated for, with a simultaneous transmission of the rotary motion.

To adjust the height or level of the gripper strip 4, for example, to raise the gripper strip 4 for processing thin paper, the adjusting head 23 at the actuating location 22 is rotated in clockwise direction, as viewed from the top of the figure of the drawing. With this feature, the threaded sleeve 18 is displaced downwardly, as viewed in the figure of the drawing, in a direction towards the cylinder axis 7, in accordance with the pitch of the thread 19. The guide pin 17 mounted on the threaded sleeve 19 thereby pivots the rocker arm 14 clockwise, as viewed in the figure of the drawing, about the bearing location of the rocker arm 14 on the gripper bar 3. The adjusting strip 8 articulatedly connected to the leg 12 of the rocker arm 14 is displaced towards the right-hand side of the figure of the drawing, so that the pins 11 on the wedge elements 9 slide upwardly and adjustably displace the gripper impact strip 4 radially outwardly. The transmission of the rotary movement of the adjusting shaft 21 to the mirror-symmetrically disposed adjusting shaft 21' on the opposite side thereof thereby occurs through the intermediary of the entrainer pins 37 and 38 of the displaceable coupling 31.

I claim:

1. In a sheet-guiding cylinder for a printing press having two diametrically opposing gripper bars disposed at the cylinder circumference and made up of gripper shafts, grippers and gripper impact strips, an adjustment device for adjusting the height of the gripper impact strips, comprising respective adjusting shafts provided for the gripper impact strips, a coupling connecting said adjusting shafts to one another and compensating for an axial adjusting movement of said adjusting shafts, and an actuating element actuatable from the cylinder circumference for adjusting the height of the gripper impact strip at at least one of the gripper bars.

2. The adjustment device according to claim 1, wherein each of the gripper bars is provided with one of said actuating elements.

3. The adjustment device according to claim 1, including an adjusting strip, and a rocker arm for transmitting a rotary adjusting movement of a respective adjusting shaft into a translatory adjusting movement of said adjusting strip.

4. The adjustment device according to claim 1, wherein said coupling is formed of two aligned receivers, respectively, provided in said adjusting shafts, and respective entrainers received in said receivers and connecting said adjusting shafts to one another.

5. The adjustment device according to claim 4, wherein said receivers are bores, and said entrainers are pins, respectively, received in said bores.

6. The adjustment device according to claim 4, wherein at least one of said entrainers is axially displaceably disposed with respect to the respective adjusting shaft in at least one of said receivers.

* * * * *

UNITED STATES PATENT AND TRADEMARK OFFICE

CERTIFICATE OF CORRECTION

PATENT NO. : 5,826,510

DATED : October 27, 1998

INVENTOR(S) : Rudi Haupenthal

It is certified that error appears in the above-identified patent and that said Letters Patent is hereby corrected as shown below:

On the title page,
Item [30] should read as follows:

| | | | |
|---|---|---|---|
| Dec. 17, 1996 | [DE] | Germany | 29 62 190-- |
| Sept. 10, 1997 | [DE] | Germany | 19 73 957 |

Signed and Sealed this

Thirteenth Day of July, 1999

*Attest:*

*Attesting Officer*

Q. TODD DICKINSON

*Acting Commissioner of Patents and Trademarks*